US011667426B2

(12) United States Patent
Zhu et al.

(10) Patent No.: US 11,667,426 B2
(45) Date of Patent: Jun. 6, 2023

(54) FOLDABLE CONTAINER AND CLEANING TOOL ASSEMBLY

(71) Applicant: JIAXING JACKSON TRAVEL PRODUCTS CO., LTD, Jiaxing (CN)

(72) Inventors: Xuelin Zhu, Jiaxing (CN); Zhongfu Liu, Jiaxing (CN)

(73) Assignee: JIAXING JACKSON TRAVEL PRODUCTS CO., LTD, Jiaxing (CN)

( * ) Notice: Subject to any disclaimer, the term of this patent is extended or adjusted under 35 U.S.C. 154(b) by 281 days.

(21) Appl. No.: 16/991,060

(22) Filed: Aug. 12, 2020

(65) Prior Publication Data

US 2021/0047069 A1 Feb. 18, 2021

(30) Foreign Application Priority Data

Aug. 16, 2019 (CN) ..... 201921330824.X

(51) Int. Cl.

| | |
|---|---|
| ***B65D 8/14*** | (2006.01) |
| ***B65D 5/02*** | (2006.01) |
| ***B65D 81/34*** | (2006.01) |
| ***A45F 3/20*** | (2006.01) |
| ***B65D 1/22*** | (2006.01) |

(Continued)

(52) U.S. Cl.

CPC ..... *B65D 1/225* (2013.01); *B65D 1/0292* (2013.01); *B65D 21/068* (2013.01)

(58) Field of Classification Search

CPC .... B65D 1/225; B65D 1/0292; B65D 21/086; B65D 21/068; B65D 1/265; B65D 11/20; B65F 2220/1066; B65F 2220/106; B65F 2220/1063; A45C 7/0031; A45C 7/0036; A45F 3/20; A45F 2003/205; A47G 2019/2277; A47K 1/04

USPC ..... 220/6, 666, 8, 592.2, 769, 806; 206/218

See application file for complete search history.

(56) References Cited

U.S. PATENT DOCUMENTS 1,581,418 A * 4/1926 Baker ..... A45F 3/20 229/400

3,301,293 A * 1/1967 Santelli ..... B65D 1/0292 297/DIG. 8

(Continued)

FOREIGN PATENT DOCUMENTS

CN 203319069 U 12/2013

CN 304462483 S 1/2018

(Continued)

*Primary Examiner* — Gideon R Weinerth

(74) *Attorney, Agent, or Firm* — Bayramoglu Law Offices LLC

(57) ABSTRACT

A foldable container and a cleaning tool assembly are provided. The foldable container includes a foldable side wall disposed annularly. The foldable side wall includes two adjacent connecting parts connected through a flexible part. When the foldable container is unfolded, the connecting parts rotate around a fold part on the flexible part. A first abutting part and a second abutting part are respectively disposed on two sides of the fold part and are arranged on the flexible part or the connecting parts. When the foldable container is in an unfolded state, the first abutting part abuts against the second abutting part. The cleaning tool assembly includes a cleaning tool and the foldable container. When the foldable container is unfolded to be used, the first abutting part abuts against the second abutting part.

19 Claims, 5 Drawing Sheets

(51) Int. Cl.
*B65D 21/06* (2006.01)
*B65D 1/02* (2006.01)

(56) References Cited

U.S. PATENT DOCUMENTS 3,578,415 A * 5/1971 Hiltz ..... C01B 3/00 220/8
5,439,128 A * 8/1995 Fishman ..... B65D 21/086 206/218
8,887,949 B2 * 11/2014 Tuan ..... A45C 11/20 220/784
9,079,685 B2 * 7/2015 Sudakoff ..... B65D 43/0218
9,221,582 B2 * 12/2015 Wheeler ..... B65D 21/086
10,196,169 B2 * 2/2019 Tsui ..... D06F 95/002
2005/0127074 A1 * 6/2005 Kusuma ..... B65D 21/086 220/6
2006/0096929 A1 * 5/2006 Repp ..... A47J 19/00 210/740
2008/0099476 A1 * 5/2008 Fung ..... B65D 15/16 220/6
2009/0065509 A1 * 3/2009 Schuler ..... A47J 43/24 220/573.1
2009/0114657 A1 * 5/2009 Hsu ..... B65D 21/086 220/574
2013/0032592 A1 * 2/2013 Lee ..... B65D 21/086 220/8
2013/0277364 A1 * 10/2013 Kusuma ..... A45F 3/20 220/8
2014/0061193 A1 * 3/2014 Sudakoff ..... B65D 43/0218 220/628
2015/0083736 A1 * 3/2015 Wheeler ..... B65D 21/086 220/666
2015/0251795 A1 * 9/2015 Tsui ..... B65D 1/0292 215/379
2015/0251808 A1 * 9/2015 Tsui ..... D06F 95/002 211/41.6
2015/0291309 A1 * 10/2015 McGregor ..... B65D 21/086 220/573.1
2016/0347503 A1 * 12/2016 Tsui ..... B65D 21/086
2016/0368664 A1 * 12/2016 Balmes ..... A45F 3/20
2017/0188740 A1 * 7/2017 Shicheng ..... A47J 27/002
2019/0075973 A1 * 3/2019 Charleson ..... A47J 43/27
2019/0373994 A1 * 12/2019 Zemel ..... A45C 5/045
2020/0305584 A1 * 10/2020 Tuan ..... A47G 19/00
2021/0047069 A1 * 2/2021 Zhu ..... A47K 1/04
2021/0130039 A1 * 5/2021 Forest ..... B65D 1/26
2022/0009676 A1 * 1/2022 Tuan ..... B65D 39/12
2022/0167796 A1 * 6/2022 Miner ..... A47J 43/0727
2022/0250797 A1 * 8/2022 Tuan ..... A45C 7/0036

FOREIGN PATENT DOCUMENTS

JP 3051331 * 12/2000 ..... B65D 21/08
TW 202007597 A * 2/2020

* cited by examiner

FOLDABLE CONTAINER AND CLEANING TOOL ASSEMBLY

CROSS REFERENCE TO THE RELATED APPLICATIONS

This application is based upon and claims priority to Chinese Patent Application No. 201921330824.X, filed on Aug. 16, 2019, the entire contents of which are incorporated herein by reference.

TECHNICAL FIELD

The present invention relates to the field of domestic storage containers, in particular to a foldable container and a cleaning tool assembly, BACKGROUND Some common domestic storage containers, such as dirty clothes hampers, dustbins and basins, are designed to be foldable so as to be transferred easily and to save the storage space. Along with the simplification of structures and the improvements on materials, the folding part of these foldable storage containers is typically formed by directly folding and unfolding flexible materials such as soft rubber. These flexible materials can be stably self-supported when folded and unfolded. For example, Chinese Utility Model Patent Publication No. CN203319069U discloses a stretchable vehicle dustbin, and Chinese Design Patent Publication No. CN3044624835 discloses a basin (foldable basin).

The folds as the weakest parts of these designs compromise the force bearing capacity of the whole side wall and are not yet specially improved in the prior art.

SUMMARY

The objective of the present invention is to overcome the above-mentioned drawbacks of the prior art by providing a foldable container, which can ensure the good force bearing capacity of the side wall when the foldable container is unfolded to be used.

The technical solution adopted by the present invention to solve the afore-mentioned problems is to provide a foldable container, which comprises a foldable side wall which is disposed annularly, wherein the foldable side wall comprises two adjacent connecting parts which are connected through a flexible part; when the foldable container is to be unfolded, the connecting parts rotate around a fold part on the flexible part; a first abutting part and a second abutting part are respectively disposed on two sides of the fold part and are arranged on the flexible part or the connecting parts; and when the foldable container is in an unfolded state, the first abutting part abuts against the second abutting part.

Furthermore, the flexible part has a concave surface, wherein the fold part is located on the concave surface, and the first abutting part and the second abutting part are arranged on the concave surface of the flexible part and are located at two ends of the concave surface respectively.

Furthermore, the first abutting part and/or the second abutting part are/is protrusions formed on the connecting parts.

Furthermore, the foldable container further comprises a rigid bottom and a rigid top, and the bottom and the top are connected through the side wall.

Furthermore, the number of the connecting parts is three, and the three connecting parts are respectively a first connecting part, a second connecting part and a third connecting part; the two ends of the second connecting part are connected to the first connecting part and the third connecting part through flexible parts respectively; and when to be folded, the folding direction of the first connecting part and the second connecting part is opposite to that of the first connecting part and the third connecting part.

Furthermore, the number of the connecting parts is an odd number greater than three.

Furthermore, the bottom and the top are made of hard rubber, and the side wall is made of soft rubber.

Furthermore, the side wall is connected to the bottom through hot melting or bonding, and the side wall is connected to the top through hot melting or bonding.

The present invention further provides a cleaning tool assembly which comprises a cleaning tool and the foldable container, wherein the cleaning tool is received in the foldable container in a folded state. Compared with separated transportation of the cleaning tool and the foldable container, the overall size of the cleaning tool and the foldable container transported as an assembly is reduced, thus effectively reducing the transportation cost.

When the foldable container provided by the present invention is unfolded to be used, the first abutting part abuts against the second abutting part, so that the strength of the weakest part, namely the fold part, of the foldable container is improved, and the force bearing capacity of the side wall is improved.

BRIEF DESCRIPTION OF THE DRAWINGS

Specific implementations of the present invention are further expounded below in conjunction with the accompanying drawings.

REFERENCE SIGNS

Figure 1:
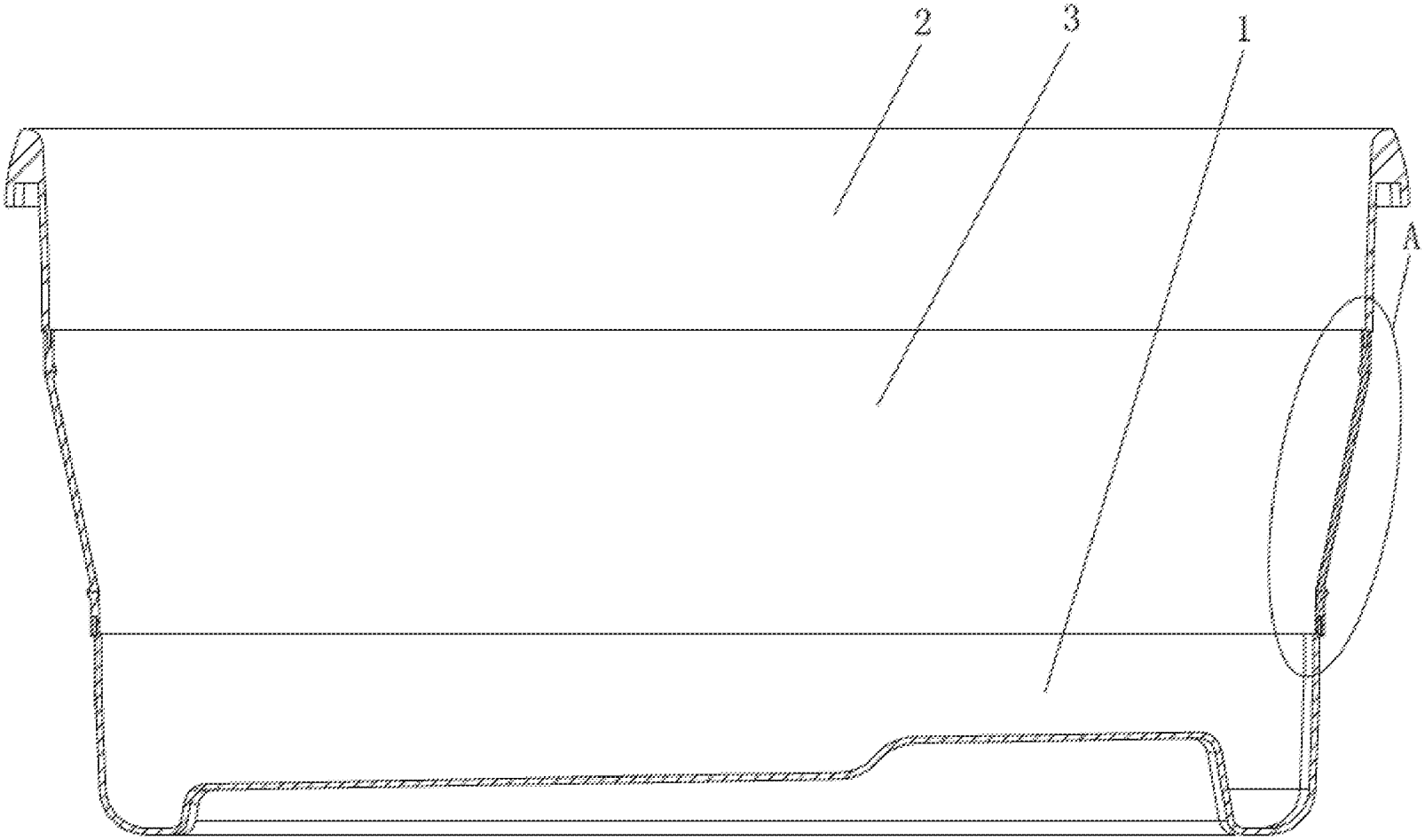
FIG. 1 is a sectional view of a foldable container in a fully unfolded state of the present invention.
Figure 2:
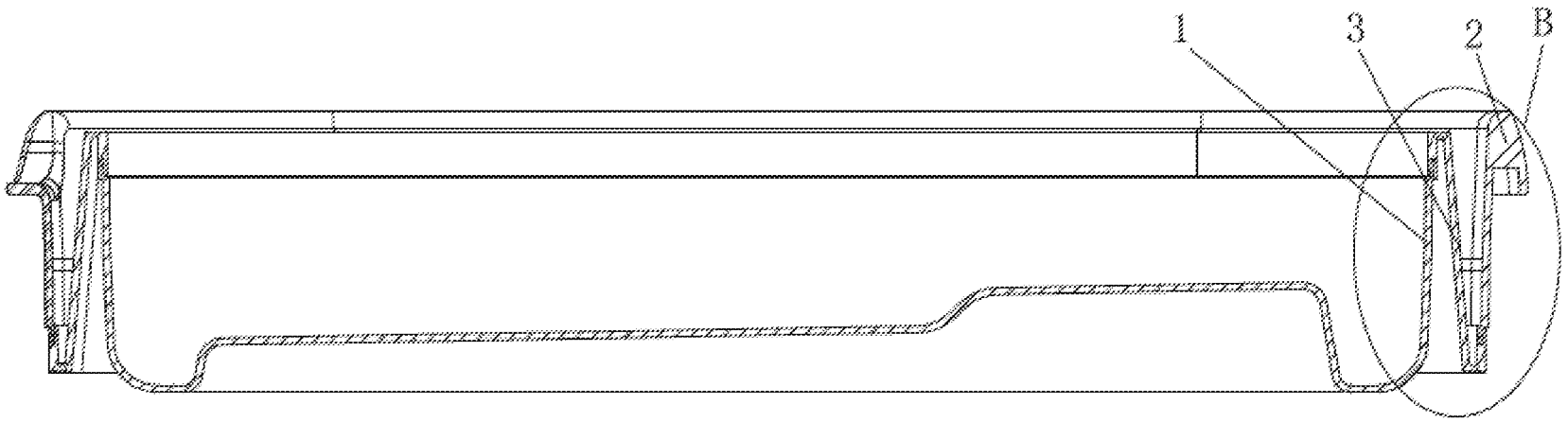
FIG. 2 is a sectional view of the foldable container in a fully folded state of the present invention.
Figure 3:
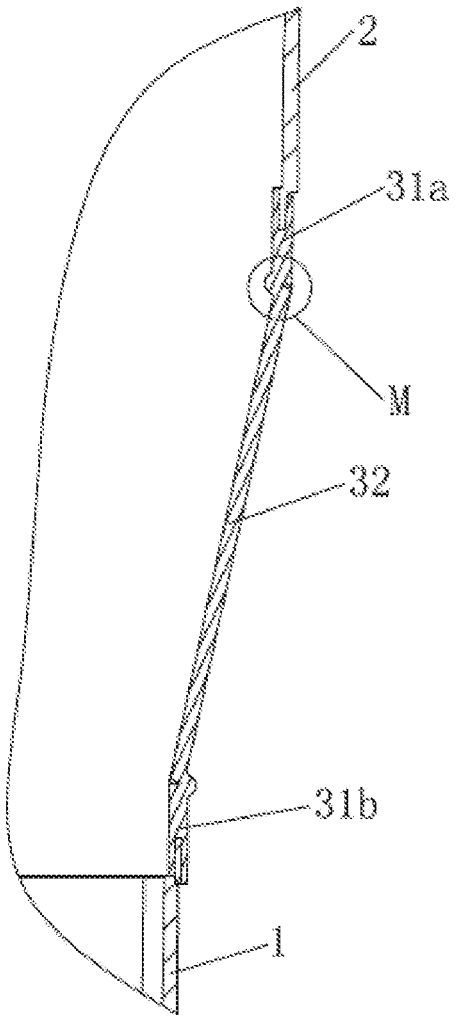
FIG. 3 is an enlarged view of part A in FIG. 1.
Figure 4:
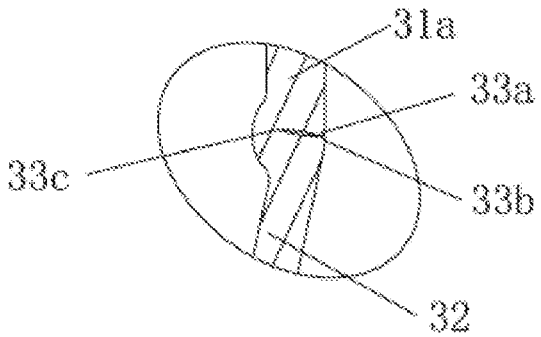
FIG. 4 is an enlarged view of part M in FIG. 3.
Figure 5:
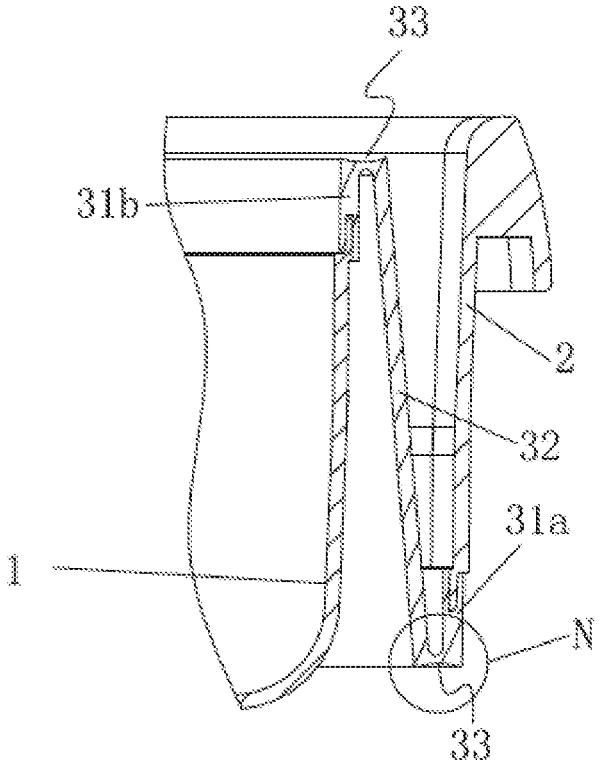
FIG. 5 is an enlarged view of part B in FIG. 2.
Figure 6:
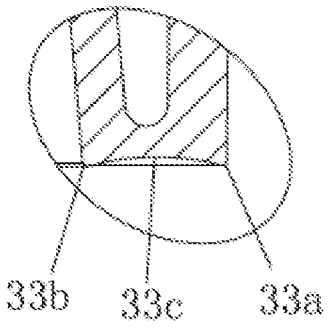
FIG. 6 is an enlarged view of part N in FIG. 5.

1, bottom; 2, top; 3, side wall; 31*a*, first connecting part; 31*b*, third connecting part; 32, second connecting part; 33, flexible part; 33*a*, first abutting part; 33*b*, second abutting part; 33*c*, fold part.

DETAILED DESCRIPTION

For the sake of a better understanding of the purposes, technical solutions and advantages of the present invention, the present invention is further expounded below in conjunction with the accompanying drawings and embodiments. It should be appreciated that the specific embodiments in the following description are merely used to explain the present invention, and are not intended to limit the present invention.

A foldable container of the present invention is suitable for various common domestic storage containers such as dustbins, dirty clothes hampers, basins, storage boxes and toothbrush cups.

As shown in FIG. 1-FIG. 6, the foldable container of the present invention comprises a foldable side wall 3 which is disposed annularly. The foldable side wall 3 comprises two adjacent connecting parts which are connected through a flexible part 33. When the foldable container is to be unfolded, the connecting parts rotate around a fold part 33*c* on the flexible part 33. A first abutting part 33*a* and a second abutting part 33*b* are disposed on two sides of the fold part 33*c* respectively and are arranged on the flexible part 33 or the connecting parts. When the foldable container is in an unfolded state, the first abutting part 33*a* abuts against the second abutting part 33*b*. When fully folded or unfolded, the adjacent connecting parts are in a stable state. When the adjacent connecting parts are fully folded, the foldable container occupies the least space, thus being easy to transport and store. When the adjacent connecting parts are fully unfolded, the foldable container is in a service state. When the foldable container is in the unfolded state, the first abutting part 33*a* and the second abutting part 33*b* abut against each other to be mutually supported, so that the connection strength of the adjacent connecting parts is enhanced, and the force beating capacity of the side wall 3 is improved.

In this embodiment, the flexible part 33 has a concave surface. The fold part 33*c* is located on the concave surface. The first abutting part 33*a* and the second abutting part 33*b* are disposed on the concave surface of the flexible part 33 and are located at two ends of the concave surface respectively. The concave surface enables the container wall to be in a natural state in a folded state, so that the situation where the container wall is stretched in the folded state in the prior art; and consequentially, the service life of a rotation joint of the side wall 3 is affected is avoided; and in the unfolded state, the container wall on a base will not be squeezed like the prior art. Preferably, in this embodiment, the fold part 33*c* serves as the base of the concave surface, and the first abutting part 33*a* and the second abutting part 33*b* are symmetrically distributed. When the adjacent connecting parts are rotated to be fully unfolded, the base of the concave surface is folded, and the symmetrical ends of the concave surface abut against each other. When the concave surface is folded in half, the wall thickness of the joint of the adjacent connecting parts is uniform, so that the stability of the foldable container in the unfolded state is improved.

Another implementation of the first abutting part 33*a* and the second abutting part 33*b* is as follows: the first abutting part 33*a* and/or the second abutting part 33*b* are/is protrusions formed on the connecting parts.

The foldable container of the present invention further comprises a rigid bottom 1 and a rigid top 2. The bottom 1 and the top 2 are connected through the side wall 3. The rigid bottom 1 improves the force bearing capacity of the foldable container, and the rigid top 2 allows users to transfer or move the foldable container easily.

The number of the connecting parts may be greater than two. By increasing the number of the connecting parts, the storage capacity of the foldable container can be improved without expanding the transport and storage space of the foldable container. Preferably, the number of the connecting parts is an odd number greater than three. By setting the number of the connecting parts as an odd number, it is guaranteed that a free end of the top 2 can be away from the folded part of the foldable container, thus expanding the design space of the free end of the top 2. For example, a flange, a handle or the like may be added to facilitate actual usage of the foldable container.

In this embodiment, the number of the connecting parts is three, and the three connecting parts are respectively a first connecting part 31*a*, a second connecting part 32 and a third connecting part 31*b*. The first connecting part 31*a*, the second connecting part 32 and the third connecting part 31*b* are sequentially arranged from top 2 to bottom 1, and the two ends of the second connecting part 31 are connected to the first connecting part 31*a* and the third connecting parts 31*b* through flexible parts 33 respectively. When to be folded, the folding direction of the first connecting part 31*a* and the second connecting part 32 is opposite to that of the first connecting part 31*a* and the third connecting part 31*b*. That is, the first connecting part 31*a* and the third connecting part 31*b* are folded towards the inner side and the outer side of the second connecting part 32 respectively. In this embodiment, the radial size of an inner cavity of the foldable container becomes larger gradually from bottom 1 to top 2. When to be folded, the first connecting part 31*a* is folded outwards with respect to the second connecting part 32, and the third connecting part 31*b* is folded inwards with respect to the second connecting part 32. After being folded, the bottom 1, the side wall 3 and the top 2 are sequentially arrayed from inside to outside. Or, the radial size of the inner cavity of the foldable container becomes smaller gradually from bottom 1 to top 2. When to be folded, the first connecting part 31*a* is folded inwards with respect to the second connecting part 32, and the third connecting part 31*b* is folded outwards with respect to the second connecting part 32. When the foldable container is in the folded state, the bottom 1, the side wall 3 and the top 2 are sequentially arrayed from outside to inside. In this embodiment, "inner" and "outer" are consistent with an inward direction and an outward direction of the foldable container in the folded state. All these simple transformations should also fall within the protection scope of the present invention.

Preferably, the bottom 1 and the top 2 are made of hard rubber, and the side wall is made of soft rubber. The side wall 3 is connected to the bottom 1 through hot melting or bonding, and the side wall 3 is connected to the top 2 through hot melting or bonding.

Figure 7:
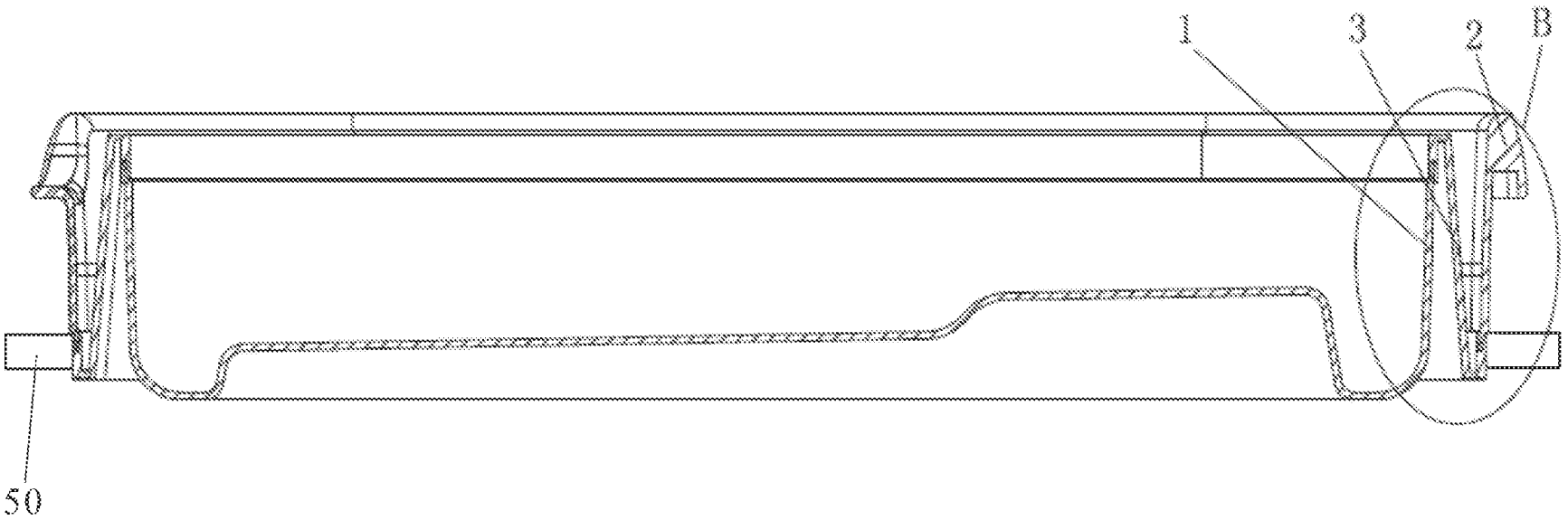
FIG. 7 is a sectional view of a cleaning tool assembly of the present invention.

With reference to FIG. 7, a cleaning tool assembly of the present invention comprises a cleaning tool 50 and the foldable container mentioned above. The cleaning tool is received in the foldable container in a folded state. The cleaning tool may be a mop, a broom, a cleaning brush or a glass brush which is frequently used in life. Compared with separated transportation of the cleaning tool and the foldable container, the overall size of the cleaning tool and the foldable container transported as an assembly is reduced, thus effectively reducing the transportation cost.

The embodiments described above in the specification are merely exemplary ones of the present invention. Various modifications, supplements or similar substitutions made to the specific embodiments described above by those skilled in the art without departing from the consents of the specification of the present invention or going beyond the scope defined by claims should also fall within the protection scope of the present invention.

What is claimed is:

1. A foldable container, comprising a foldable side wall;

wherein the foldable side wall is disposed annularly the foldable side wall comprises a plurality of connecting parts, and the plurality of connecting parts comprise a first connecting part and a second connecting part, wherein the first connecting part and the second connecting part are adjacent to each other and connected through a flexible part; when the foldable container is unfolded, the first connecting part and the second connecting part rotate around a fold part on the flexible part;

a first abutting part and a second abutting part are respectively disposed on two sides of the fold part;

the first abutting part is arranged on the flexible part, and the second abutting part is arranged on the first connecting part or the second connecting part;

or the first abutting part and the second abutting part are arranged on the flexible part;

or the first abutting part and the second abutting part are arranged on the first connecting part or the second connecting part; and when the foldable container is in an unfolded state, the first abutting part abuts directly against the second abutting part and wherein the flexible part has a concave surface having a continuous concavity throughout the concave surface; the fold part is located on the concave surface; the first abutting part and the second abutting part are arranged on the concave surface of the flexible part and are located at two ends of the concave surface, respectively.

2. The foldable container according to claim 1, further comprising a rigid bottom and a rigid top, wherein the rigid bottom and the rigid top are connected through the foldable side wall.

3. The foldable container according to claim 2, wherein, a number of the plurality of connecting parts is an odd number greater than three.

4. The foldable container according to claim 2, wherein, the rigid bottom and the rigid top are both made of hard rubber, and the foldable side wall is made of soft rubber.

5. The foldable container according to claim 4, wherein, the foldable side wall is connected to the rigid bottom and the rigid top through hot melting or bonding.

6. The foldable container according to claim 1, wherein, at least one of the first abutting part and the second abutting part is a protrusion, wherein the first abutting part is formed on the first connecting part, and the second abutting part is formed on the second connecting part.

7. The foldable container according to claim 6, further comprising a rigid bottom and a rigid top, wherein the rigid bottom and the rigid top are connected through the foldable side wall.

8. The foldable container according to claim 7, wherein, a number of the plurality of connecting parts is an odd number greater than three.

9. The foldable container according to claim 7, wherein, the rigid bottom and the rigid top are both made of hard rubber, and the foldable side wall is made of soft rubber.

10. The foldable container according to claim 9, wherein, the foldable side wall is connected to the rigid bottom and the rigid top through hot melting or bonding.

11. The foldable container according to claim 1, further comprising a rigid bottom and a rigid top, wherein the rigid bottom and the rigid top are connected through the foldable side wall.

12. The foldable container according to claim 11, wherein, a number of the plurality of connecting parts is an odd number greater than three.

13. The foldable container according to claim 11, wherein, the rigid bottom and the rigid top are both made of hard rubber, and the foldable side wall is made of soft rubber.

14. The foldable container according to claim 13, wherein, the foldable side wall is connected to the rigid bottom and the rigid top through hot melting or bonding.

15. The foldable container according to claim 1, wherein the plurality of connecting parts further comprise a third connecting part; a first end of the second connecting part is connected to the first connecting part through a first flexible part, and a second end of the second connecting part is connected to the third connecting part through a second flexible part; and when the foldable container is folded, a folding direction between the first connecting part and the second connecting part is opposite to a folding direction between the first connecting part and the third connecting part.

16. A cleaning tool assembly, comprising a cleaning tool and the foldable container according to claim 1, wherein the cleaning tool is received in the foldable container in a folded state.

17. The cleaning tool assembly according to claim 16, wherein, the flexible part has a concave surface having a continuous concavity throughout the concave surface; the fold part is located on the concave surface; the first abutting part and the second abutting part are arranged on the concave surface of the flexible part and are located at two ends of the concave surface, respectively.

18. The cleaning tool assembly according to claim 16, wherein, each of the first abutting part and the second abutting part is a protrusion, wherein the first abutting part is formed on the first connecting part, and the second abutting part is formed on the second connecting part.

19. The cleaning tool assembly according to claim 16, further comprising a rigid bottom and a rigid top, wherein the rigid bottom and the rigid top are connected through the foldable side wall.

* * * * *